US005367841A

United States Patent [19]

Smith et al.

[11] Patent Number: 5,367,841

[45] Date of Patent: Nov. 29, 1994

[54] CONTAINING STRUCTURE FOR ABRASIVE BLAST HEAD RIGGING AND TANK SIDE CLEANING APPARATUS

[76] Inventors: Michael D. Smith, 5632 Zion Church Rd., Concord, N.C. 28025; George F. Wells, 7209 English Ivy Ln., Charlotte, N.C. 28227

[21] Appl. No.: 17,814

[22] Filed: Feb. 16, 1993

[51] Int. Cl.[5] ..... B24C 9/00

[52] U.S. Cl. ..... 451/89; 451/87; 451/92

[58] Field of Search ..... 51/410, 424, 426, 427, 51/428, 429

[56] References Cited

U.S. PATENT DOCUMENTS

| | | | |
|---|---|---|---|
| 4,095,378 | 6/1978 | Urakami | 51/425 |
| 4,121,388 | 10/1978 | Wilson | 51/429 |
| 4,199,905 | 4/1980 | Neidigh et al. | 51/429 |
| 4,281,485 | 8/1981 | Charity, III | 51/425 |
| 4,305,344 | 12/1981 | Baskett | 118/305 |
| 4,360,990 | 11/1982 | Hubbard et al. | 51/426 |
| 4,754,581 | 7/1988 | Lengyel et al. | 51/426 |
| 4,787,179 | 11/1988 | Lewis | 51/426 |
| 4,825,598 | 5/1989 | Schlick | 51/410 |
| 4,866,889 | 9/1989 | Goldmann | 51/426 |
| 4,949,512 | 8/1990 | Thomann | 51/426 |
| 5,011,710 | 4/1991 | Harrison | 427/142 |
| 5,018,320 | 5/1991 | Anguelo et al. | 51/426 |
| 5,038,527 | 8/1991 | Fastje | 51/426 |
| 5,199,229 | 4/1993 | Herold et al. | 51/426 |

OTHER PUBLICATIONS

Magazine article: *Journal of Protective Coatings & Linings*, pp. 85–92, by Timothy Gazda, P.E., C/P Utility Services Company, title of article: "Understanding Total Enclosure Containment with Negative Air", in the Jan. 1992, vol 9, No. 1 issue.

*Primary Examiner*—M. Rachuba
*Attorney, Agent, or Firm*—Judith E. Garmon

[57] ABSTRACT

A portable containment structure for abrasive blasting equipment is designed for particular application in the cleaning of large storage tanks and for bridges. The unit includes a portable blasting room which fully encloses the blasting apparatus and operating personnel, in a secure environment having ventilating and vacuum means for the safe removal and containment of particulate materials and contaminates. The unit is supported by cables and includes rigging which provides for both horizontal and vertical movement along the surface being treated.

5 Claims, 9 Drawing Sheets

CONTAINING STRUCTURE FOR ABRASIVE BLAST HEAD RIGGING AND TANK SIDE CLEANING APPARATUS

BACKGROUND OF THE INVENTION

In the environment of cleaning the surfaces of large structures such as fuel storage tanks, bridges, and other walled environments, it is known to use abrasive blasting systems for removal of dirty or contaminated surface finishes. It is also known to rig such blasting systems with flexible containment devices or portable rooms which isolate the area, and contain the dust and particulate material as it is being collected by vacuum systems. Generally such systems include a closed loop ventilation system whereby air is introduced to the containment area and withdrawn through at least one separator means for removal of abrasive and contaminated materials.

On-site abrasive cleaning processes produce large quantities of a portion of particulate materials, grit, and dust, a portion of which escapes into the atmosphere, collects on surrounding or adjacent surfaces, and is inhaled by workers. Such loss of containment is acceptable when non-hazardous materials are involved. However, where hazardous materials such as lead paint, asbestos, and the like are removed, the threat to the environment and the health of personnel is substantially greater.

The physical structure of prior systems conventionally is based on the vertical movement up and down the surface being cleaned one section at a time. Most are supported by cables, as in the staging type generally used for window cleaning; or, supported on scaffolding rigs which must be dismantled at least partially when moved from one section to another. With such riggings, any lateral (or horizontal relative to the work surface) movement of the structure is inhibited or eliminated.

Further problems related to prior art systems involve an inability to isolate a work area and enable the maintenance of a constant air pressure, and the maximum entrapment and evacuation of removed, frequently contaminated materials. In known systems the enclosure of the area is most often accomplished with sheet materials that are draped over the scaffolding and held in place with tie-downs and riggings much like those used with canopies and tents. Use of such loosely-formed enclosures prohibits the formation of a controlled air flow for ventilation or for entrapment of particulate material. Additionally, such enclosures are frequently subjected to high winds, which winds can become trapped and completely destroy the enclosure; often jeopardizing the safety and lives of operators. In known devices, when weather conditions change abruptly, it is virtually impossible to lower the enclosure rapidly and prevent damage and/or injury.

With regard to adequate containment of removed particulate materials, prior art devices utilizing suspension rigging or scaffolding have proven to be highly ineffective. While vacuum systems are employed, there remains a large amount of material which is not entrained in the vacuum and falls to the ground around the structure. This creates a necessity for secondary collection of residue, increasing the time and cost requirements for the operation. While such secondary collections previously were a problem only in increased time, there now exists a question of ground contamination from hazardous materials such as lead paint.

These same hazardous materials not only become ground contamination when they are improperly contained, but may also be found in blood samples taken periodically from operators.

SUMMARY OF THE PRESENT INVENTION

The present invention is a highly improved containment apparatus and system for use in abrasive blasting operations on a variety of structures. By use of a novel structural design the present invention overcomes the above-discussed disadvantages with known systems and enables a highly efficient entrapment of particulate material and debris. The basic structure is that of a portable room having a structural frame and an overlying skin of air pervious material securely attached to the frame. A portion of the frame includes aluminum wear plates for structural stability and increased durability. An operators' cage and ventilation/exhaust system are contained with and in the portable room, forming an efficient, safe operative unit.

The unit as a whole is suspended by a system of cables and rollers on the side of a work surface such as a large fuel tank, and is movable in both vertical and horizontal planes. The suspension and motion systems are designed such that the necessity of dismantling for movement from one work area to another is unnecessary, whether in a horizontal or vertical direction. Thus there is no need to dismantle any secondary structure before progressing to an adjacent work area.

In the event of changing environment conditions such as weather, the unit can be lowered to the ground at an estimated speed of twenty-five feet per minute. This means that from the standard height of a fuel storage tank at forty-eight feet, the unit can be lowered to the ground in approximately two minutes. The safety of operating personnel and of the unit itself is greatly enhanced by this factor alone.

With regard to the containment and removal of contaminated materials, as it is removed by blasting, these materials and the abrasive blasting media fall to a collection pan in the floor of the containment unit, where it is evacuated by a controlled vacuum system. If any such material manages to escape the closed edges of the containment unit it falls to the ground and is recaptured in a secondary collection. However, because the edges of the containment unit tightly abut the surface being cleaned, any such escape is minimal and secondary cleanup is substantially eliminated.

The surface-abutting edges of the containment unit include resilient seal plates therearound for conforming to the work surface. The size or arcuate configuration of the seals on the horizontal surface - abutting edges of a given containment unit are adjustable to accommodate and conform to multiple tank diameters.

The interior, operator work area is designed to support and somewhat isolate the operator(s) out of the range of the majority of particulate material rebound. Although operators wear protective clothing and masks, it remains desirable to protect them and their clothing as much as possible. Hand rails front and back of a staging unit, toe plates and rails on front and back, and positioning of the staging approximately half-way back into the unit, inhibit movement into the immediate area of abrasive blasting.

Ventilation air is supplied through the air permeable skin of the unit and evacuated at a controlled rate. Because the configuration and size of the containment unit is fixed, it is possible at every stage of operation to definitively calculate the linear feet per minute of evacuation air that is needed. Unlike prior art units which are not of consistent configuration, with the present unit it is possible to position the air flow conduits (relative to the operator) such that collection and evacuation of contaminants is maximized.

Two sources of exhaust collection separate and then entrap dust contaminated air flow, and dense material air flow which includes grit, large paint chips, etc. A rotary classifier is used to sort grit which is recaptured for later reuse, dust which is filtered before air is exhausted to the environment, and paint chips which are collected for storage in drums which are disposed of.

The containment unit or room includes a removable top portion that is used when the upper areas of a work surface are being treated. The removable top includes a structural frame such as the primary unit, and a containment tarp with a forward drape that is used around the wind girders of the storage tank and completely encloses the containment unit until lower areas of the work surface are reached and can be engaged by both the vertical and horizontal surface—abutting edges of the primary containment unit. This top obviously eliminates loss of contaminated material into the surrounding environment.

BRIEF DESCRIPTION OF THE DRAWINGS

Other objects and advantages of the present invention will become apparent to those skilled in the art as the following detailed description is studied in conjunction with the accompanying drawings. In the drawings.

DETAILED DESCRIPTION OF A PREFERRED EMBODIMENT

Figure 1:
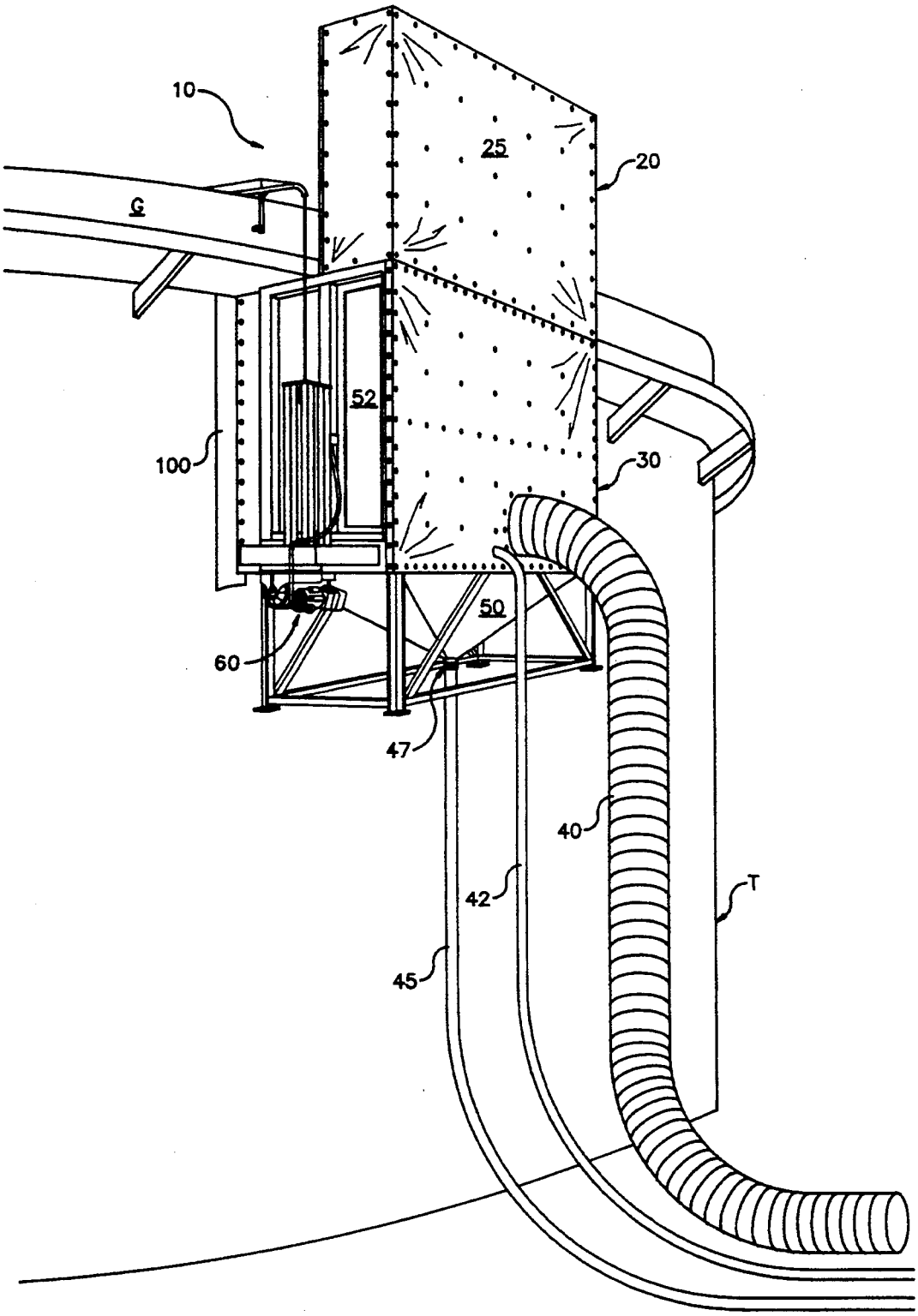
FIG. 1 is an environmental perspective view of a preferred embodiment of the present invention in operative position on the side of a fuel storage tank.
Figure 2:
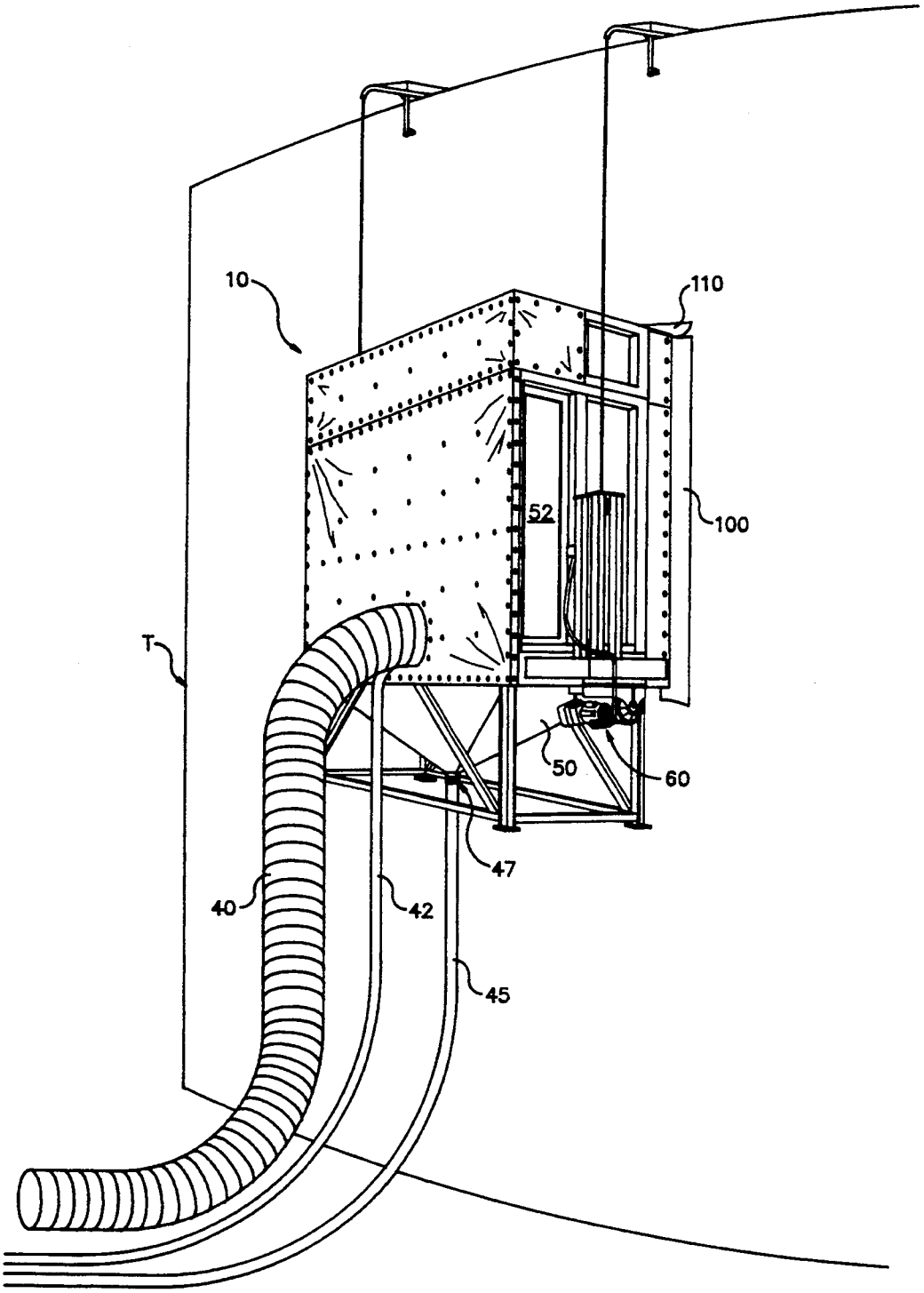
FIG. 2 is a perspective view of the invention of FIG. 1, shown from the opposite side, with upper portion removed, and the unit lowered vertically to another work area.

Looking first at FIG. 1, the containment unit 10 is shown in a preferred embodiment in suspension on the side of a large storage tank T such as used for fuel. In FIG. 1 the containment unit 10 is positioned at the upper area on the vertical side of the storage tank as would be the conventional starting point for an abrasive blasting process used for such surface treatment as lead paint abatement. This unit includes the removable top portion 20 utilized around the wind girder G on the tank. This top portion 20 includes the same structural frame as will be described below for the primary containment unit 30 and includes a skin 25 overlying the supporting frame. A forward drape (not shown), in conjunction with outer skin 25 enables complete containment of the unit. When surface cleaning around the top of the tank and wind girder G is complete, the removable top 20 is taken off the unit and stored. Because the entire unit 10 can move horizontally around the tank, the top 20 can remain in place until the upper surface areas of the tank T are completed. When the unit is lowered vertically to another work area, top 20 is no longer required.

Ventilation is provided through the air permeable skin 25 and a large duct, approximately sixteen to twenty inches in diameter, exhausted by means of conduit 40 as will be described in more detail below. Abrasive grit is supplied to the sand blast nozzle through conduit 42, and particulate material is evacuated by exhaust through vacuum conduit 45. The vacuum conduit 45 is connected to an outlet 47 approximately four inches in diameter in the funnel-shaped catch pan 50 which is mounted underneath the entire structural unit. The operator cage or support stage to be described below is mounted above the catch pan 50 and all grit and debris falls into the pan.

Dust contaminated air is exhausted through conduit 40 and is filtered through multiple HEPA filters before exhausting into the atmosphere.

A door 52 is provided on at least one sidewall of the containment unit for operator ingress and egress. Motors 60 and operatively connected cables (best shown in FIG. 7) provide motion to the unit.

Figure 3A:
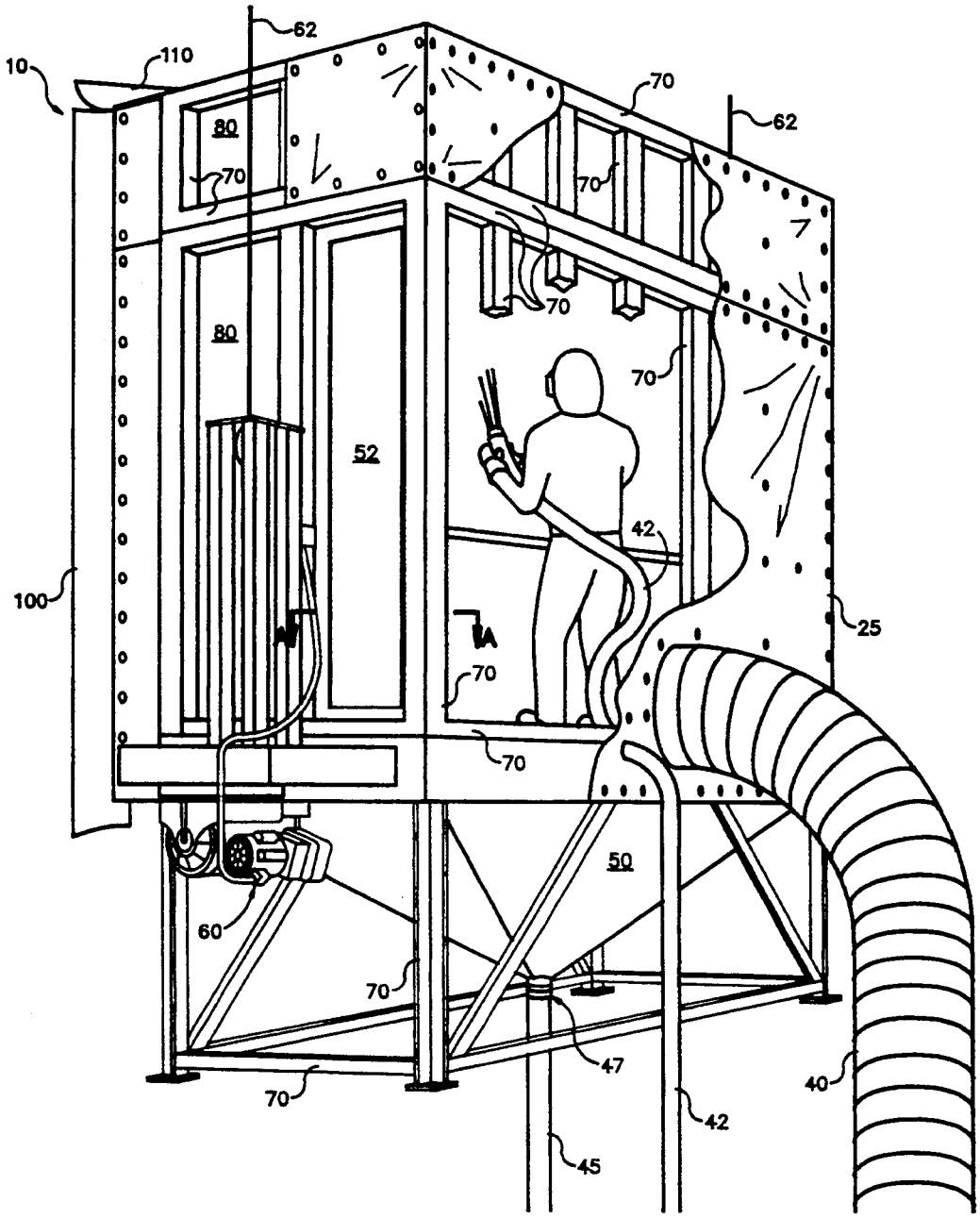
FIG. 3A is a perspective view with parts broken away, and in greater detail of the unit shown in FIGS. 1 and 2.
Figure 3B:
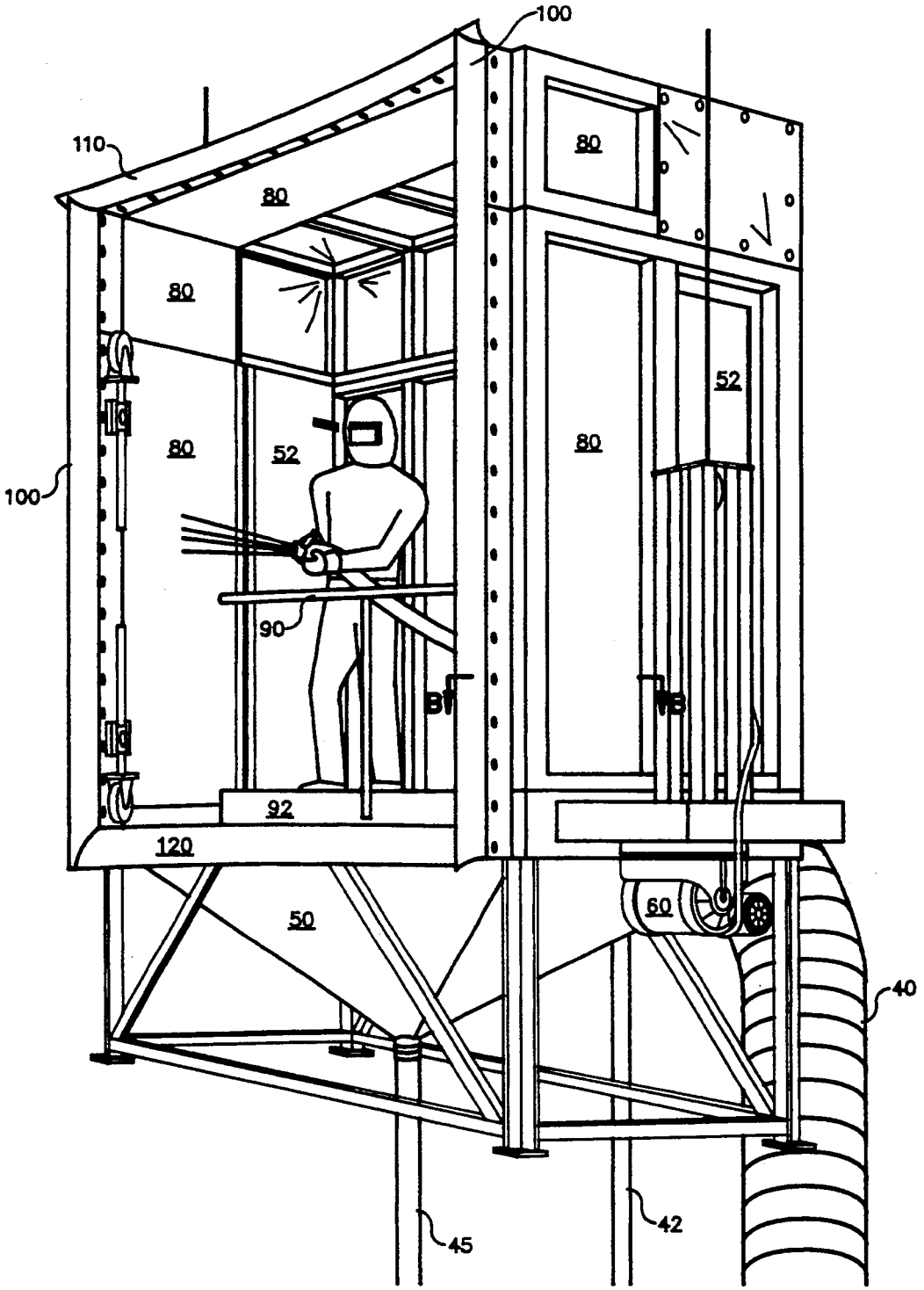
FIG. 3B is a perspective view of the unit, looking toward the open, tank-engaging side and the interior.
Figure 4:
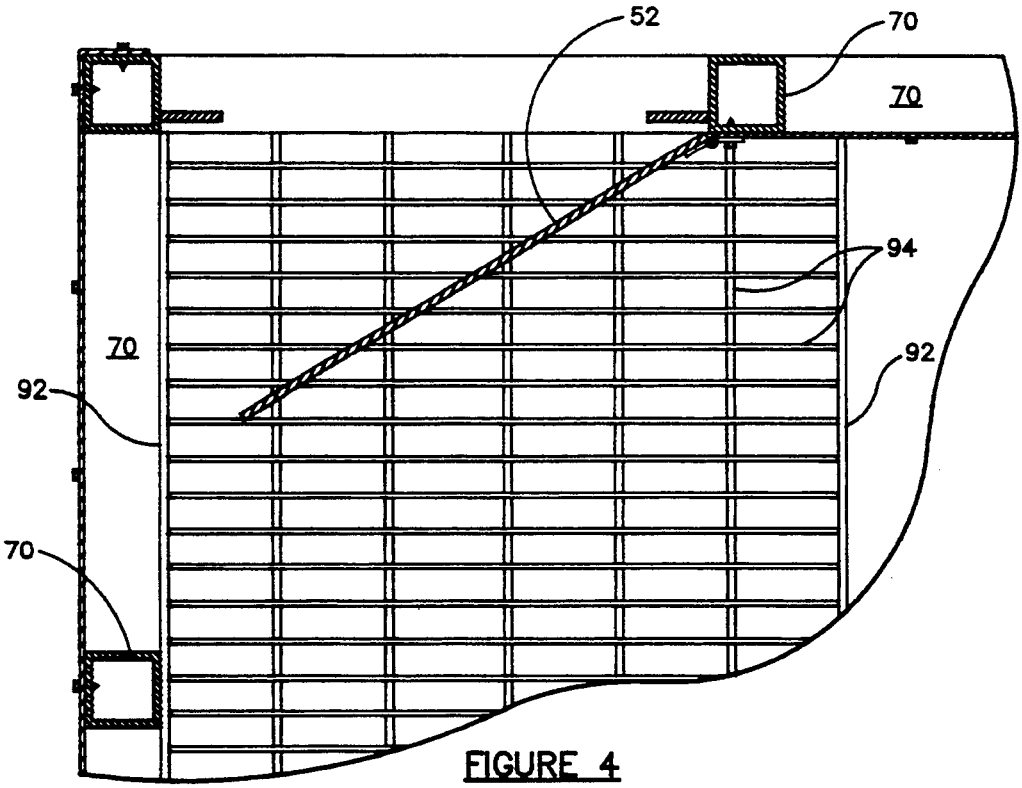
FIG. 4 is a plan view, with parts broken away, looking downwardly into the unit from the top.
Figure 5:
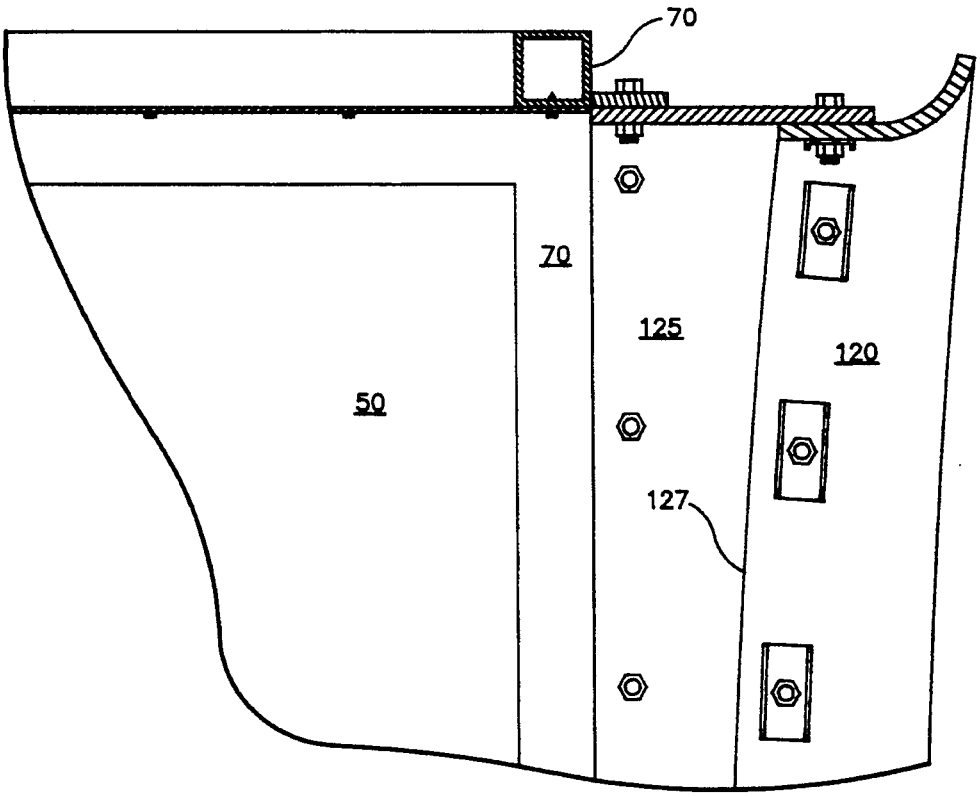
FIG. 5 is a plan view, with parts broken away, and taken along lines B-B of FIG. 3-B.
Figure 6:
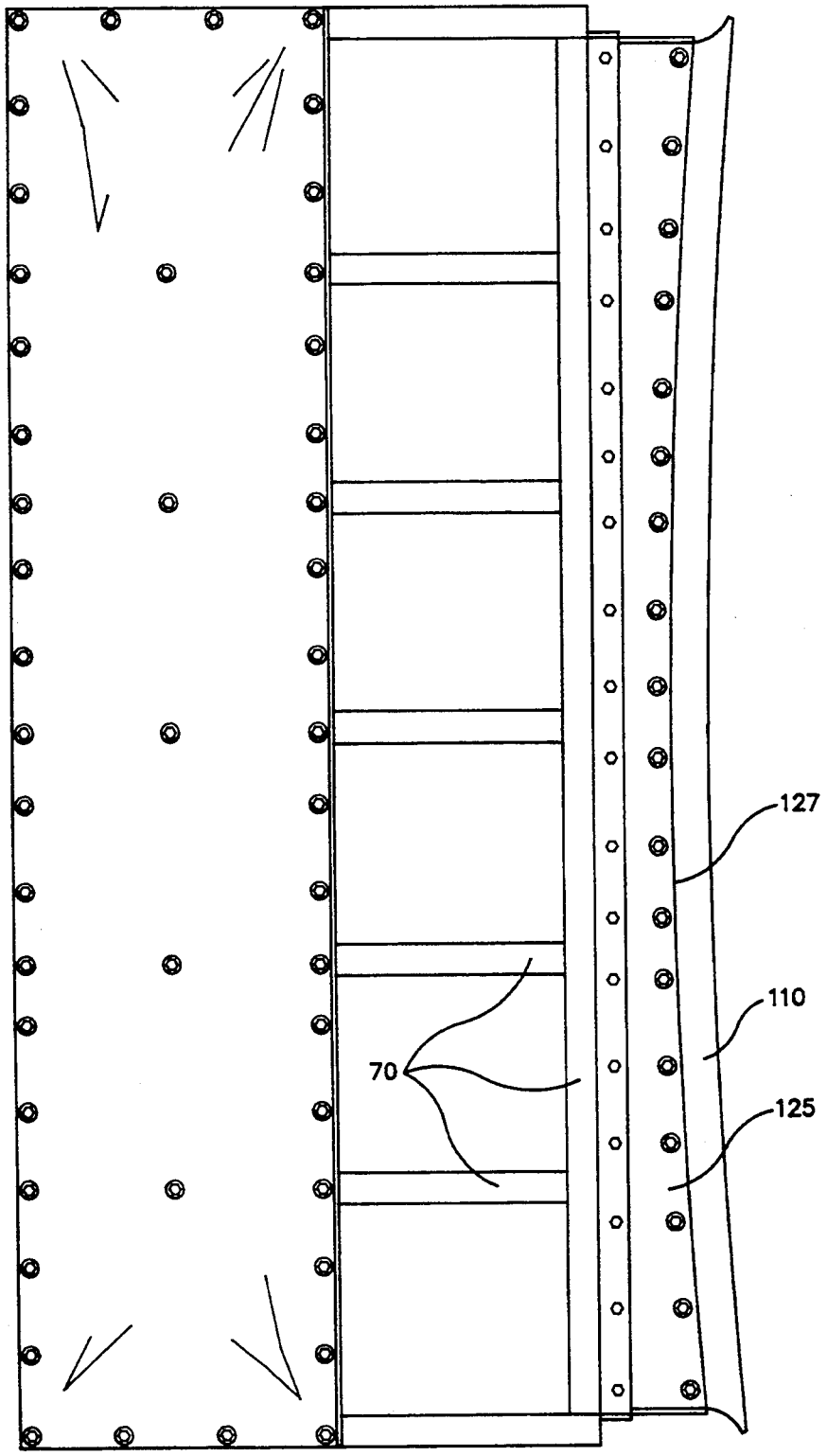
FIG. 6 is a plan view of the top of the containment unit.

Looking next at FIG. 3 through 5 the structural frame for the containment unit 10 is shown to be comprised of metallic tubing, 70 preferably aluminum, two inches square, welded together to form a rectangularly shaped framework approximately $12' \times 4' \times 11'$. The selected material is of maximum strength, preferably welded using a heliarc process.

Overlying the tubular frame is an outer skin comprised of the aforementioned air permeable material 25, and a plurality of sheet metal wear plates 80. The wear plates 80 preferably are made of aluminum sheeting, grade 60–61, and are replaceable when worn. The plates 80 are used as side plates on the forward half of the frame; that portion which is positioned adjacent the surface being cleaned. The wear plates are screwed onto the tubular frame.

Over the rearward portion of the unit, beyond wear plates 80 and away from the surface being treated, the air permeable fabric skin 25 is screwed onto the sides and top. The preferred fabric for the skin 25 is a geotextile tarp material, preferably a monofilament polypropylene. One such material is manufactured by Eagle Industries.

The preferred fabric is a 95% containment fabric which allows approximately 5% outside air flow therethrough, and in the present invention the fabric skin 25 is the only source of incoming fresh air. Because the containment unit 10 is a constant size, and the fabric skin is known to permit a predictable rate of air flow therethrough, air pressure within the unit 10 is constantly controlled. Ambient, dust laden air from within the unit 10 is exhausted through the major exhaust conduit 40 at a rate of approximately 150 linear feet per minute. The 20" conduits 40 entrance is protected by deflector plate to prevent excess abrasive, personal protection equipment or otherwise from entering the exhaust duct 40.

If anything is inadvertently pulled into the conduit 40 it would be trapped in the filtration area and prevented from being pulled into exhaust fans. Although not shown in the present drawings the exhaust fans are mounted in the clean air flow path, isolated from workers by the multiple HEPA filters.

Referring to FIGS. 3B and 4 the components of the worker containment stage are shown to include handrails 90, toe plates 92 on the front and back of the stage to prevent the feet from moving outside the staging area. The floor of the staging is comprised of metal grating 94, weld mounted on channel iron, which allows the contaminants such as paint chips to fall through to the collection pan 50. Positioning of the staging area is such that it preferably extends less than one-half the distance from the tank wall T to the rear fabric wall 25 of containment unit 10.

FIGS. 3 through 5 also illustrate flexible sealing panels 100, 110, 120 which are formed of natural or synthetic rubber, or other similar flexible material. The sealing panels are secured to the vertical side edges, top and bottom edges of the containment unit and seal against the walls T of the tank or other work surface. The panels 100, 110, 120 are approximately one-inch thick along the long edge that is clamped or bolted to one edge of a connecting flange plate 125. The flange plates extend from each of the side, top and bottom walls of the containment unit 10. The panels taper from the one-inch thickness on the flange connecting edge to approximately one-half inch thickness on the edge that contacts the tank wall T. The top and bottom flange plate 125 include an arcuate forward edge 127. The size of the flange plates can be adjusted for use on tanks of various diameters. For example, one set of flange plates 125 having a facial radius of sixty feet at edge 127 will work on tanks having outside diameters of one hundred to one hundred and fifty feet.

Figure 7:
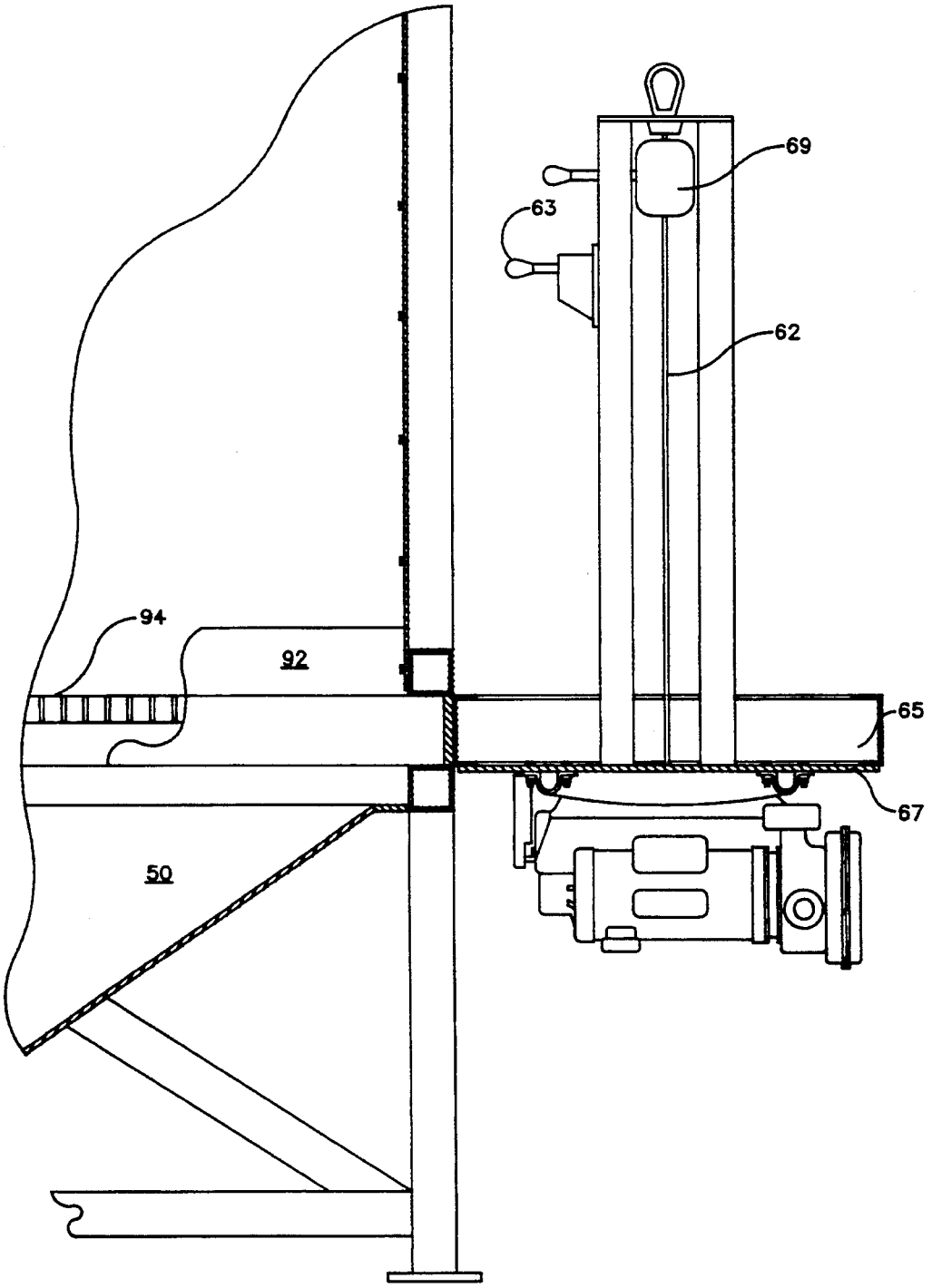
FIG. 7 is a plan view, with parts broken away looking toward the open, tank-engaging side of the unit.

FIG. 7 illustrates the pair of motors 60, each of which is mounted on a platform, 65 extending from the outer surfaces of the side walls of the containment unit. The undersurfaces 67 of the platforms include one-half inch thick aluminum plates 67 to which the motors are bolted. The motors control vertical movement on cables 62 and are activated by motor switch 63. A cable lock 69 secures against movement once the containment unit is in position.

Figure 8:
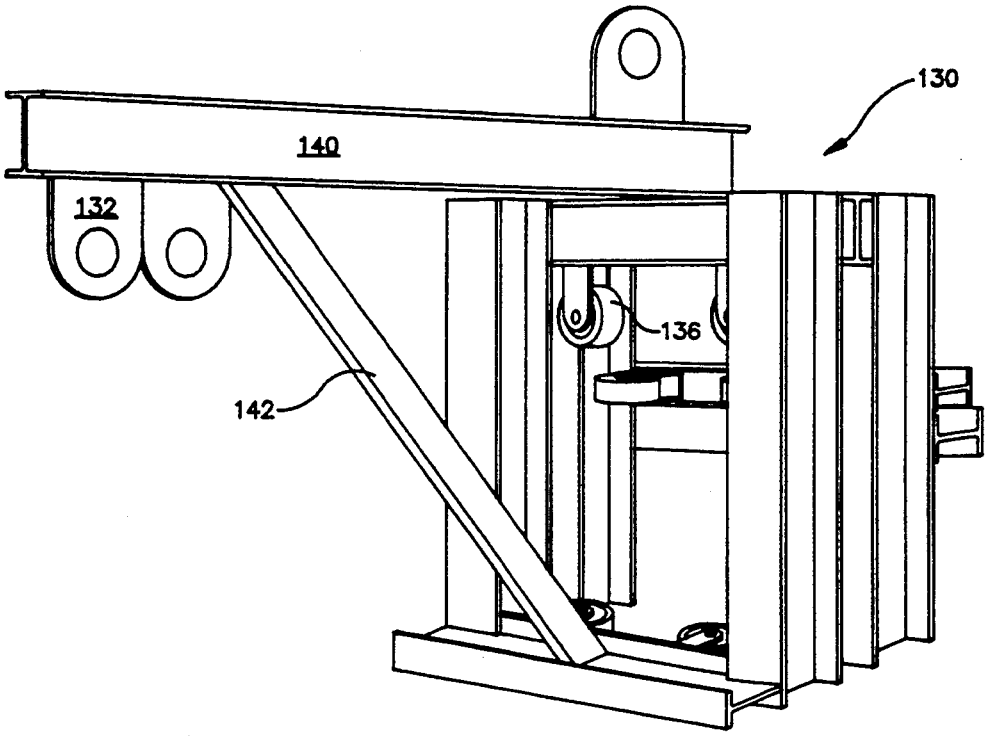
FIG. 8 is a perspective view of a portion of the support rigging for the containment unit.
Figure 9:
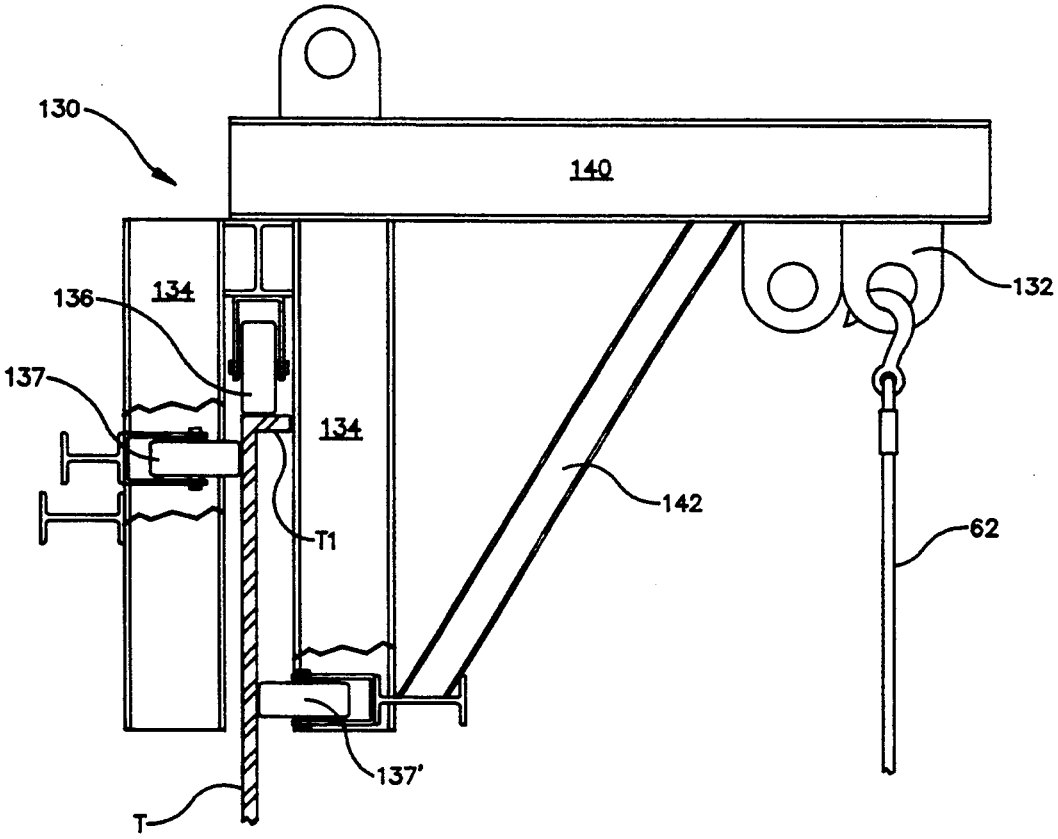
FIG. 9 is a view of a portion of the rigging which enables horizontal movement of the unit.

FIGS. 8 and 9 illustrate the rigging which enables horizontal movement along the wall of tank T. The cable 62 from the motor is hooked to a large wheeled bracket or support fixture. 130 by means of an eyelet member 132. The fixture 130 is made of a plurality of steel I-beams 134 welded together to house a plurality of rollers or wheels 136 and 137 which engage the surface of the tank wall T. The uppermost wheels 136 are contained between opposingly mounted I-beams 134 in a channel which receives the tank wall T. Wheels 136 roll along surface T1 of the wall. Wheels 137 and 137' are mounted in planes extending perpendicular to the vertical plane of wall T; pair 137 positioned near the inner surface of top edge adjacent wheels 136, and the pair 137' spaced below and on the outer surface of tank wall. A steel I-beam 140 is mounted on top of the fixture, supported by brace 142, and including the liplets 132 to which cables 62 are hooked.

The motors, switches, and cable locking units are of the type generally used on spider staging platforms (such as used by window washers), and the containment unit 10 is pushed up rather than pulled. The unit 10 cannot fall unless the cables break because the wrenches are pushing in compression rather than in suspension.

Figure 10:
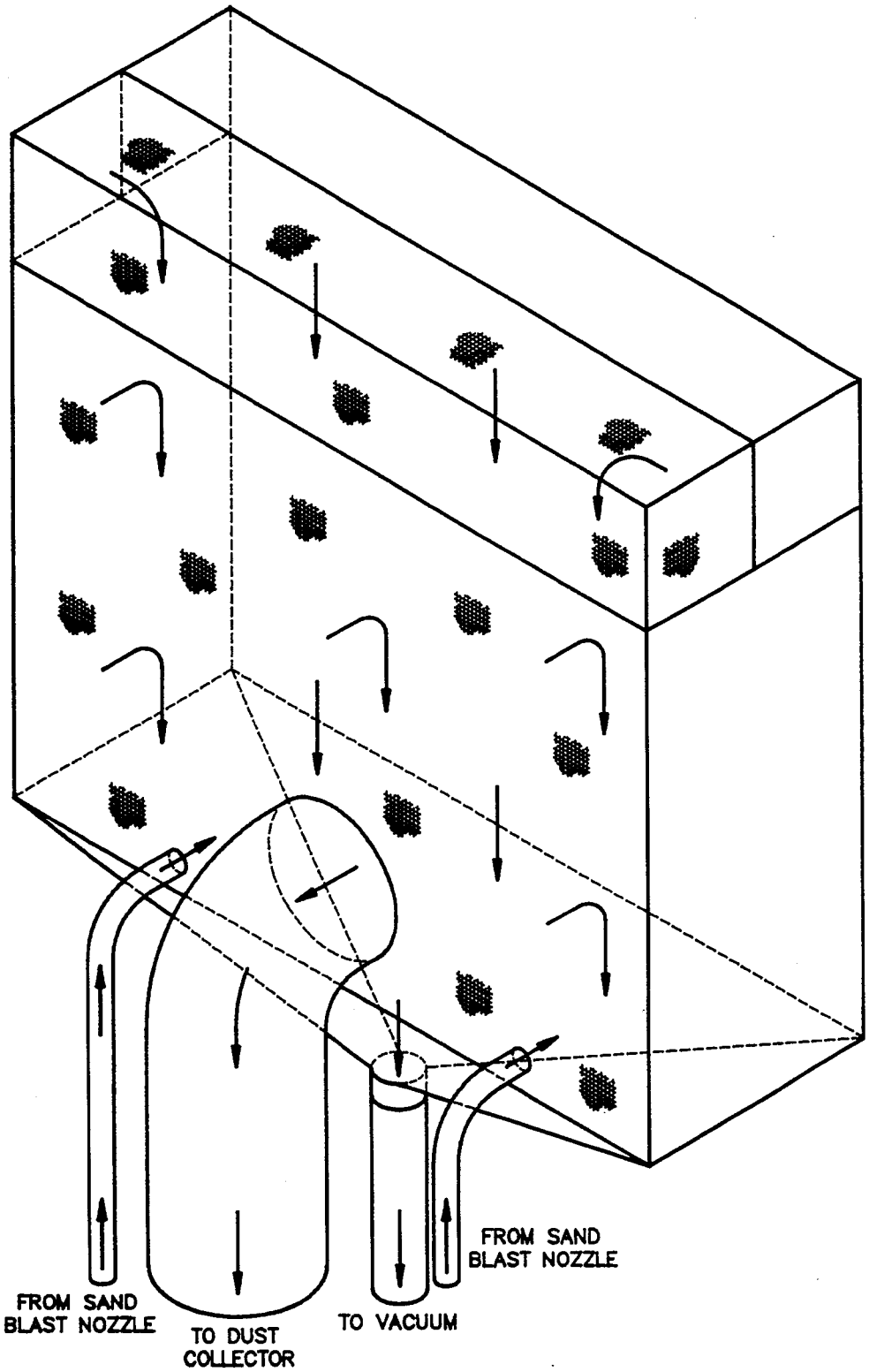
FIG. 10 is a diagrammatic view of the air flow patterns and exhaust system.

FIG. 10 is self-explanatory in that it is a diagnostic illustration of air flow patterns in the containment unit. The only incoming ambient air is via the air permeable skin 25, exhausted as described before through conduit 40. The conduit 40 is positioned behind the operator and relatively low on the back wall of the unit to maximize flow through the unit.

The basic operation of containment unit 10 involves the placement of at least two of the rigging fixtures 130 on the upper surfaces of tank wall T, followed by running cables 62 up to connect to the rigging. So mounted the containment unit 10 sits against the wall of the tank T. The widewall, top, and bottom edges of the unit are sealed against the tank wall by means of the flexible rubber sealing panels. Operators enter the unit via doors 52, appropriately suited for blasting operations. Ventilation is begun by use of exhaust fans in conduit 40, and vacuum hose 45 is connected to the outlet of catch pan 50. Abrasive grit is blown in via conduit 42 to the blasting nozzle and returned by means of the vacuum for washing, separation and reuse. Operators temporarily shut down blasting during the horizontal or vertical travel times from one work area to another. Supplemental lights, heating and cooling are available in the containment unit as needed.

While only a basic form of abatement process has been described, it must be understood that other processes can be utilized in the present invention and structural modifications made while remaining within the scope of the claims below.

What is claimed is:

1. A portable containment unit for an abrasive blasting system and process, for preventing escape of grit and contaminated particulate material into the atmosphere; said containment unit including:

A) A portable, substantially rectangular room enclosure having a supporting frame and a skin overlying said frame, with at least a portion of said skin being formed of a selected air permeable material;

B) a collection pan mounted underneath said supporting frame for receiving the fallout of grit and particulate matter resulting from the abrasive blasting process;

C) air circulating means for supplying air to the interior of said room enclosure; and vacuum means for removal of material from said collection pan;

D) support means for movably retaining said room enclosure on the side of a structural surface which is to be treated by blasting; said support means further including:

i) cable means for enabling vertical movement upwardly and downwardly along the surface being treated;

ii) rigging means including a plurality of rollers for removable attachment to the structure being treated and enabling horizontal movement in either sideways direction along the work surface;

whereby said room enclosed may be moved horizontally and vertically as desired to progress from one work area to another without dismantling any part of the unit.

2. A containment unit according to claim 1 wherein said supporting frame of said room enclosure is comprised of:

A) a plurality of elongated tubular members formed of a selected metallic material; with said tubular members joined together to form a substantially rectangular, room-shaped unit of prescribed dimensions;

B) a portion of said framework equal to approximately one-half of the total frame having as first, air impervious skin thereover; and C) the remaining portion of said frame having as second, air permeable skin thereover;

D) both said first and second skins being removably attached to said framework such that either may be removed for replacement or repair.

3. A containment unit according to claim 1 wherein said collection pan is comprised of a funnel-shaped metallic structure securely mounted to the undersurface of said supporting frame, tapering downwardly therefrom; an outlet means formed in the bottom of said collection pan at the approximate middle thereof; and connection means for connecting said vacuum means to said collection pan, for extraction of collected materials.

4. A containment unit according to claim 2 wherein said air circulating means comprises: said second, air permeable skin being formed of a geotextile material which permits a prescribed incoming air flow therethrough; and an exhaust conduit including at least one fan means operatively connected therethrough for withdrawing air from said room enclosure and exhausting to the atmosphere.

5. A containment unit according to claim 4 and further including said exhaust conduit having at least one filter means therein for filtering dust particles from the exhaust air flowing therethrough.

* * * * *